US006065514A

United States Patent [19]

New

[11] Patent Number: 6,065,514

[45] Date of Patent: May 23, 2000

[54] COMPACT HANDHELD BATTERY-OPERATED COSMETIC PENCIL SHARPENER

[76] Inventor: Mary A. New, 936 Willcliff Dr., Mechanicsburg, Pa. 17055

[21] Appl. No.: 09/258,552

[22] Filed: Feb. 26, 1999

Related U.S. Application Data

[60] Provisional application No. 60/076,245, Feb. 27, 1998.

[51] Int. Cl.[7] ..... B43L 23/02

[52] U.S. Cl. ..... 144/28.5; 30/452; 30/454; 144/28.1

[58] Field of Search ..... 144/28.1, 28.11, 144/28.5, 363; 30/450, 452, 454, 457

[56] References Cited

U.S. PATENT DOCUMENTS

| | | | |
|---|---|---|---|
| D. 377,666 | 1/1997 | Yuen | D19/73 |
| 836,712 | 11/1906 | Rush | 144/28.5 |
| 1,887,843 | 11/1932 | Ludwig . | |
| 2,561,438 | 7/1951 | Duchesneau | 120/96 |
| 3,004,522 | 10/1961 | Kent | 120/96 |
| 3,556,182 | 1/1971 | Tonigami | 144/28.5 |
| 3,650,308 | 3/1972 | Hopi | 144/28.5 |
| 3,678,975 | 7/1972 | Imanishi et al. | 144/28.5 |
| 3,746,061 | 7/1973 | Nakazaki | 144/28.5 |
| 4,050,487 | 9/1977 | Mabuchi et al. | 144/28.5 |
| 4,815,507 | 3/1989 | O'Rourke | 144/28.5 |
| 5,379,817 | 1/1995 | O'Neil et al. | 144/363 |
| 5,894,669 | 4/1999 | Luttgens | 30/452 |

*Primary Examiner*—W. Donald Bray
*Attorney, Agent, or Firm*—Carmen Santa Maria; McNees, Wallace & Nurick

[57] ABSTRACT

A portable, handheld, sharpening device for sharpening a cosmetic pencil having an outer casing of hard material and an inner casing of soft wax-like cosmetic material. The device includes a plastic housing, a steel blade for removing the outer casing of material from the cosmetic pencil while providing a tip having a radius of no larger than about ⅛" to the inner core of cosmetic material and a motor coupled to the blade to rotate the blade that is connected to at least one battery. The device is small and lightweight so that it can conveniently be stored in a pocket or a purse.

18 Claims, 2 Drawing Sheets

COMPACT HANDHELD BATTERY-OPERATED COSMETIC PENCIL SHARPENER

CROSS-REFERENCE TO RELATED APPLICATION

This application claims the benefit of Provisional Application Serial No. 60/076,245, filed Feb. 27, 1998.

BACKGROUND OF THE INVENTION

1. Field of the Invention

This invention generally relates to a portable, powered sharpener for cosmetic pencils and crayons, and specifically relates to a small, self-powered, self-contained, hand-held cosmetic pencil sharpener capable of being carried in a purse or in a pocket and that provides a sharpened cosmetic pencil or crayon having a properly radiused tip, permitting the cosmetic pencil or crayon to be sharpened easily, efficiently and without the mess involved with the disposal of shavings.

2. Description of the Prior Art

Various devices have been provided for sharpening pencils. Some devices have been directed at cosmetic pencils such as an automatic sharpener for eyebrow or lip pencils, manufactured by Z-Pointe Inc. of Ariz. While the device is small enough to be packed away for easy transport in luggage for a week-end getaway, it is not small enough to be placed in a purse or a pocket, so that convenience is limited. Other devices such as the sharpener set forth in U.S. Pat. No. 5,379,817 to O'Neil et al. dated Jan. 10, 1995, designed for use with soft element pencils have been identified. While producing acceptable points by the incorporating blades having skewed cutting edges, devices such as set forth in U.S. Pat. No. 5,379,817 are also neither portable nor self-powered, requiring again, an ac outlet for power.

U.S. Pat. No. 4,815,507 to O'Rourke dated Mar. 28, 1989, is a portable, lightweight sharpener for eyebrow pencils. While portable, it is not self-powered in that it requires an Ac outlet for power and discloses a sharpening means that provides a tip that is sharp, and therefore susceptible to breaking while producing a deposit that is too fine.

Other devices such as set forth in U.S. Pat. No. 4,050,487 to Mabuchi et al. dated Sep. 27, 1977, disclose portable, self-powered pencil sharpeners. However, a device such as is disclosed by Mabuchi et al. is not suitable for use with cosmetic pencils or crayons.

Sooner or later, many women experience frustration in dealing with dull pencil-type applicators for eyebrow liner, eye liner or lip liner. The use of these dull applicators results in the inability to achieve the detail and precision that they desire. Furthermore, conventional manually operated pencil sharpeners are often constructed of inadequate materials, causing their blades to become dull prematurely, making it difficult to use while producing poor results. These sharpeners typically contain no means by which to catch the pencil shavings, leaving the user to dispose of them.

What is lacking in the art is a portable sharpening device for sharpening the tips of cosmetic pencils and crayons that is self-powered, yet is small enough to be conveniently carried in a purse or in pants pockets, and that produces a tip that is not so sharp that it produces an unacceptable fine line and that is susceptible to cracking, yet sharp enough to be used while not destroying the exterior of the pencil or crayon so as to shorten the life of the pencil or crayon by needless removal of material.

SUMMARY OF THE INVENTION

The present invention is directed to a compact portable pencil sharpener for sharpening tips of cosmetic pencils such as is used for applying eye liner, lip liner, eyebrow liner and the like. The device is small, so that it can be conveniently carried in a purse or even in pants pockets. The present invention is a housing having a hollow interior. At one end of the housing is an aperture for receiving a pencil or crayon. The crayon typically is cylindrical in shape, having an inner core of a depositable wax-like substance, the inner core being surrounded by an outer casing of harder material such as wood. The housing may be of any shape. Within the housing is a rotatable sharpening means for removing the outer casing of hard material from the blade, while exposing the core so that it can be deposited by the user. In order to be useful, the sharpening means should produce a tip on the wax-like inner core having a radius of at least about ⅛" or smaller, while removing sufficient amounts of the hard outer casing of material to expose the wax-like inner core without destroying excess amounts of the hard casing.

The inner housing includes a driving means connected to the rotatable sharpening means, which rotates the sharpening means. Also included within the inner housing is a chamber located within the housing for receiving and temporarily storing shavings removed from the crayon or pencil. The shavings are removable from the chamber. The inner housing also includes a power means for powering the driving means and connection means between the powering means and the driving means to permit a flow of current from the powering means to the driving means.

An advantage of the present invention is that it is portable, in that it can be conveniently carried within a purse or pocket. It is self-contained, so that no external power sources are needed to operate it and it can hold a small amount of shavings from the sharpening operation. Because it is portable, being of compact design and light weight, it can be carried by persons who typically utilize cosmetics such as eye liner, lip liner, eyebrow liner and the like so that these cosmetics can be carried in the form of a pencil and can be used anywhere to provide a pencil tip having the proper geometric shape so that the cosmetic can be appropriately applied by the user.

Another advantage of the present invention is that it combines a compact design and light weight with the ability to apply a properly rounded tip to a new or used cosmetic pencil or crayon that is sharp enough to provide the desired application of cosmetic. Unlike the prior art devices which produce pencils that are too sharp, producing too fine lines and which are easily broken, or which are too blunt to provide a well-defined line. The present device provides a pencil having an appropriate radius for the application of cosmetics without unnecessarily wasting cosmetic material from the pencil.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Whenever possible, the same reference numbers will be used throughout the figures to refer to the same parts.

DETAILED DESCRIPTION OF THE INVENTION

Figure 1:
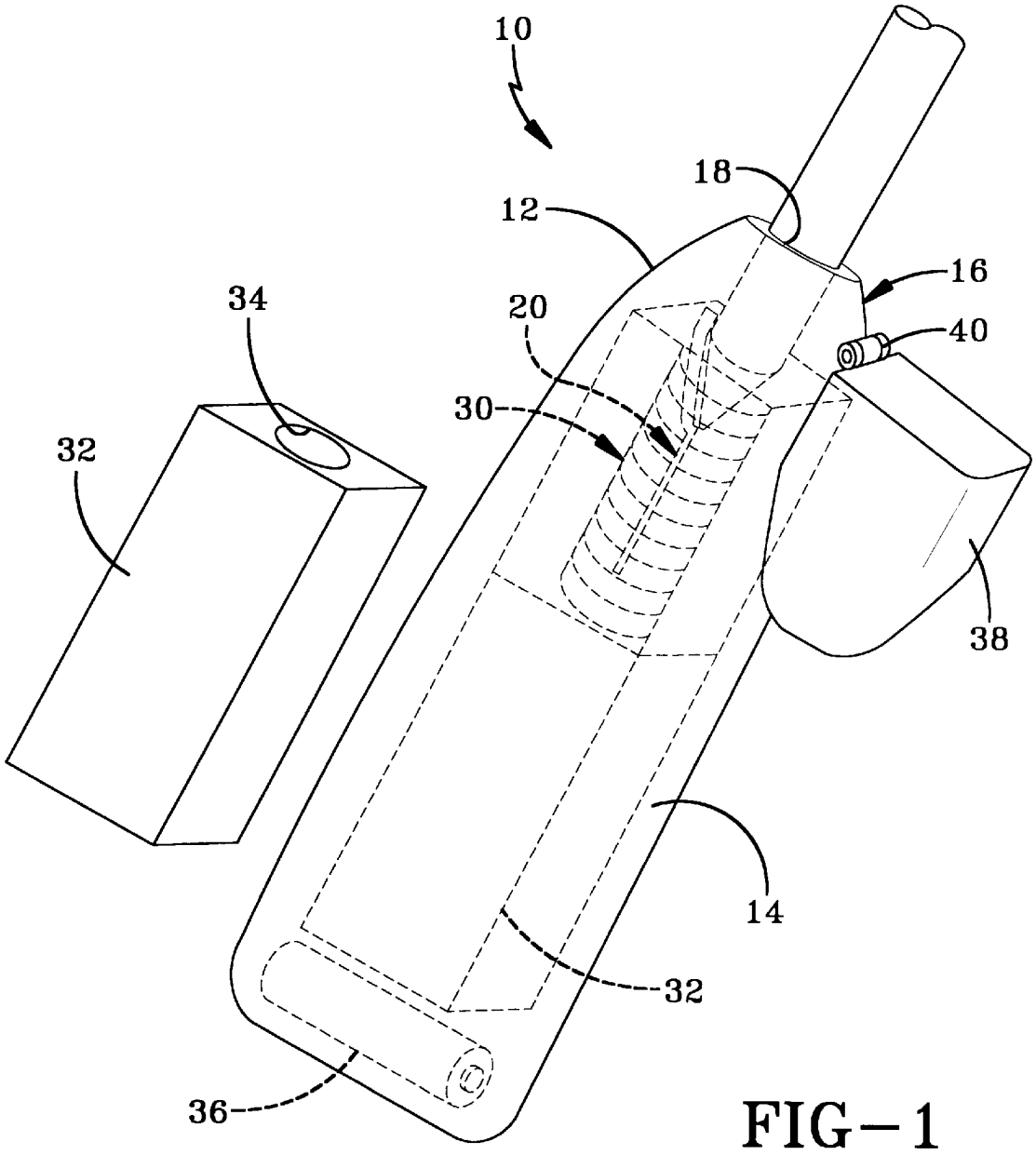
FIG. 1 is a schematic of a preferred embodiment of the present invention.

Referring now to FIG. 1, which is a schematic of the present invention. A cosmetic pencil having a soft inner core of a depositable, wax-like substance surrounded by an outer casing of hard removable material, typically wood, is depicted inserted into device 10 of the present invention. The soft wax-like substance forming the inner core is typically the cosmetic, such as eye liner or lip liner that is desired to be deposited. Device 10 includes a housing 12 having a hollow interior 14. In a preferred embodiment, housing 12 is a plastic or polymeric housing so that the weight can be kept to a minimum, while contributing to the ease of manufacturing. At a first end 16 of housing is an aperture 18 that receives the pencil or crayon. Housed within hollow interior 14 at the end of aperture 18 is a rotatable sharpening means 20. This rotatable sharpening means 20 is typically a sharpened blade made of a metal alloy such as a hardened steel blade or a tool steel. In the preferred embodiment, this blade is shown having two distinct portions, a first blade portion 22 that provides a rounded tip on an inner core at an end of cosmetic pencil or crayon inserted through aperture 18 into device 10 and a second blade portion 24 that removes an outer casing of hard material so that the inner core of wax-like material can be exposed. The housing may optionally include a cover to provide access to the blade for sharpening or replacement, while making the blade inaccessible, for safety purposes, during operation.

Coupled to the rotatable blade 20 is a motor 30, typically a direct current ("dc"). Motor 30 may be coupled to blade 20 by any known mechanical means. For example, motor 30 may provide a direct drive (not shown) to blade 20 by a threaded coupling for example. Alternatively, gearing (not shown) may provide a mechanical interface between blade 20 and motor 30. Such gearing may also provide appropriate gear reduction to optimize the speed of blade or blades, and would serve as an appropriate mechanical coupler to synchronize the operation of a two-blade system.

Positioned within hollow interior 14 and in communication with a portion of the interior that houses blade 20 is a chamber 32 to receive shavings from blade 20. In the embodiment shown in FIG. 1, chamber 32 is a removable container that can be physically withdrawn from hollow interior 14 when filled with shavings from blade 20. In this embodiment, chamber 32 includes a second aperture 34 through which shavings pass. The container is shown as removable from a side of the housing. However any convenient method of attachment may be used. For example, the container may include a threaded portion that mates with a corresponding threaded portion within the housing so that the container may be threadably attached to the housing in an axial direction. It may also be held into position by spring clips.

Also located within hollow interior 14 is a power means or power source 36. In the preferred embodiment, this power source 36 is a removable battery well known for powering portable devices. As shown in FIG. 1, power source 36 is an alkaline C, AA or AAA battery having a positive and a negative terminal and may be a plurality of batteries. However, the battery may be any other battery size or type that provides sufficient power to operate motor 30. The positive and negative terminals of power source 36 are connected by appropriate contacts to the motor to complete the required circuit. As is customary, within the circuit is an on-off switch to disconnect the power source from the motor when operation of device 10 is not required. It is not necessary that power source 36 be a battery. For example, power source 36 may be photovoltaic cells or solar cells located on the exterior of housing 12. These cells provide power when exposed to light, converting the light directly into electrical energy. When used, these cells are also appropriately wired to motor 30 to complete the required circuit, as previously noted.

As shown in FIG. 1, device 10 includes an optional lid 38 on a hinge 40 that flips over the end of device 40 that can be held in place by any suitable means such as a clip (not shown) or flip top mechanisms typically used on lighters to prevent leakage of shavings from hollow interior 14 into a purse or pocket, thereby preventing any unnecessary messes in the purse or pocket.

Figure 2:
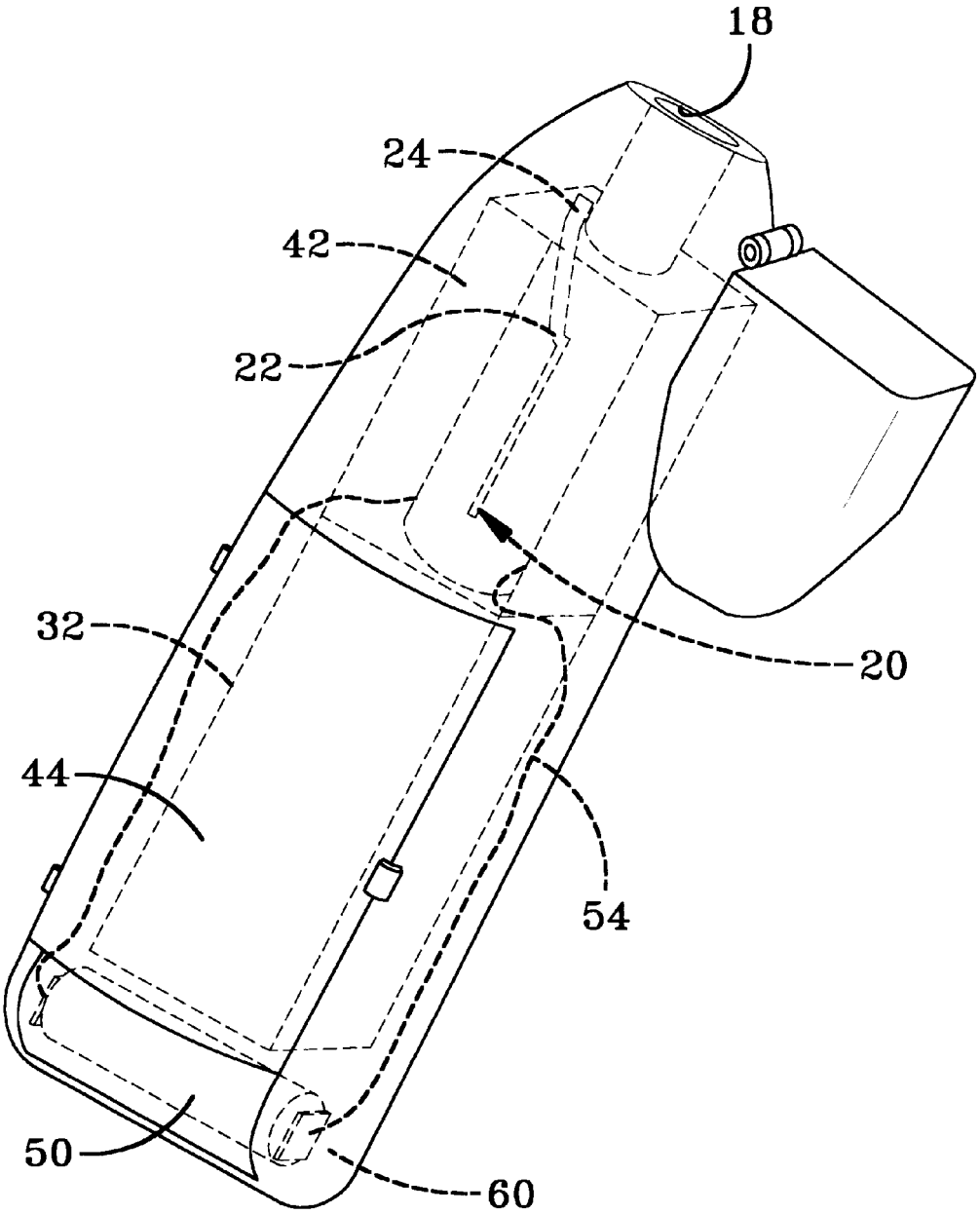
FIG. 2 is a cross-section of another embodiment of the present invention.

Referring now to FIG. 2 is a second embodiment of the present invention. In this embodiment, hollow interior 14 is formed of chamber 32, battery compartment 40, and motor/blade housing 42. Aperture 18 provides communication between housing 42 and chamber 32 so that shavings can be received into chamber 32. Chamber 32 includes a removable door 44 that may be hinged or that may be snapped into place. Door 44 can be removed so that shavings can be emptied from the interior. In a similar manner, battery compartment 40 includes a removable cover 50 to permit access for battery insertion and removal. As shown in FIG. 2, battery compartment 40 is isolated from chamber 32, but wiring 54 is provided between the battery terminals and motor 30. The device 10 also optionally may include a clip or a storage compartment for conveniently storing one or more pencils or crayons when not in use.

A switch (not shown) may be provided on the exterior of device 10 to activate the device. However, other optional switches may be included to automatically close the circuit and activate the motor. For example, rotatable sharpening means 20 in the form of a blade may include a metallic flange that is contacted by the pencil or crayon. The flange is movable and spring loaded along the axis of the device so that the force of an inserted pencil moves the flange downward against the bias of the spring into contact with a switch thereby closing the circuit. When the pencil or crayon is withdrawn the force counteracting the spring bias is removed and the spring pushes the flange out of contact with the switch thereby opening the circuit and shutting down the motor. In yet another embodiment, a spring loaded switch is biased outward into aperture 18. As a pencil or crayon is inserted into aperture 18, the outer casing of the pencil forces the switch inward away from the aperture, thereby activating the switch and closing the circuit. Once again, upon removal of the pencil from the aperture 18, the spring loaded switch moves outwardly into the aperture, opening the circuit and inactivating the motor. Other common switch arrangements may be used, and these various switching arrangements illustrate the many possibilities.

Once the crayon is inserted through the first end of housing 16 into aperture 18 to make contact with rotatable sharpening means, which has been activated by closing of a circuit so that the motor is engaged, a first blade portion of the sharpening means contacts the outer casing of hard material, gradually shaving this material from the crayon. As the crayon is further inserted, the configuration of the first blade portion is such that more of the outer casing material is removed, until the soft wax-like inner core of the crayon or pencil is exposed. This soft inner core of material is the cosmetic which is to be applied by the user. As the crayon is further inserted, the soft inner core now contacts the second blade portion of the device. This blade portion shapes the soft inner core to an appropriate shape that is desirable for application of cosmetic. It does not provide a sharpened tip as is taught by prior art devices. This second blade portion provides a tip that has a radius of from about ⅛" to about 1/16" so that cosmetics may be applied to the face of the user providing the desired line immediately, without having to first "dull" out the crayon by running it over a surface until the proper tip shape is reached, undesirably depositing material that must be disposed of as waste and shortening the life of the crayon or pencil. Most preferably, the device of the present invention has a length of about five (5) inches, and a width of about two (2) inches. However, the device may be larger, for example being of a cylindrical shape having a diameter no larger than about two and a half (2.5) inches and a length of no greater than about seven inches. An important aspect of the invention is that its size is such that it can be placed into a purse, handbag or pocket, making it truly portable. The thickness is desirably about one (1) inch. Most desirably the device is as small as possible while providing all of the features set forth above. While the device may be slightly larger than set forth above, it should not be so large that it cannot be conveniently carried around.

The present invention not only provides a device that is portable and self-powered, so that it can conveniently be carried in a purse or a pocket and be taken anywhere, but also sharpens the pencil or crayon so that the sharpened tip has the appropriate shape for application of the cosmetic. By providing the appropriate tip, it extends the life of the crayon or pencil by reducing common breakage resulting from sharp tips as well as by not unnecessarily destroying material during the sharpening process. In an optional embodiment, the device also provides for suitable storage for the crayon or pencil when not in use so that damage is minimized.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

I claim:

1. A portable, handheld sharpening device for sharpening a cosmetic pencil having an outer casing of hard material and an inner casing of soft wax-like material comprising:

a housing having an aperture at a first end;

a rotatable sharpening means positioned within the housing and adjacent to the aperture for removing the outer casing of material from the cosmetic pencil while providing a tip having a radius of about ⅛" to about ¼" to the inner casing of soft, cosmetic material;

a driving means coupled to the sharpening means to rotate the sharpening means;

a power means to power the driving means;

connection means between the power means and the driving means to permit the flow of current from the power means to the driving means; and a chamber positioned within the housing for receiving and storing material removed from the pencil by the sharpening means, the chamber located within the housing distal from the first end and sharpening means, and accessible from outside of the housing for removing stored material.

2. The portable handheld sharpening device of claim 1 further including a hinged lid for closing the apertured first end of the sharpener to prevent leakage of material removed by the blade through the aperture.

3. A portable handheld sharpener for sharpening a cosmetic pencil having an outer casing of hard material and an inner casing of soft-wax-like material comprising:

a housing having a hollow interior and an aperture at a first end for receiving the cosmetic pencil;

a rotatable blade positioned within the housing, the blade having at least two portions, a first portion for removing the outer casing of material from the cosmetic pencil and a second portion for providing a tip having a radius of at least about ⅛" to the inner core of cosmetic material;

a motor coupled to the blade to rotate the blade;

a power source to power the motor;

wiring between terminals connected to the power source and the motor to permit a flow of current from the power means to the driving means; and a removable chamber positioned within the hollow of the interior of the housing for receiving and storing material removed by the blade.

4. The sharpener of claim 3 wherein the power source is a battery and the motor is a direct current motor.

5. The sharpener of claim 3 wherein the power source is at least one photovoltaic cell.

6. The sharpener of claim 3 wherein the chamber positioned within hollow interior of the housing is a removable chamber.

7. The sharpener of claim 3 further including a switch for actuating the motor.

8. The sharpener of claim 7 wherein the switch automatically actuates the motor upon insertion of the cosmetic pencil and inactivates the motor upon withdrawal of the pencil.

9. The sharpener of claim 3 further including means for storing at least one cosmetic pencil.

10. The sharpener of claim 9 wherein the means for storing includes a storage compartment within the hollow interior housing for accepting at least one cosmetic pencil.

11. The sharpener of claim 9 wherein the means for storing includes a clip for attaching a cosmetic pencil.

12. The sharpener of claim 3 wherein the motor is directly coupled to the blade by a shaft directly driven by the motor.

13. The sharpener of claim 3 wherein the motor is coupled to the blade by at least one gear.

14. The sharpener of claim 3 wherein the motor is coupled to the blade by a plurality of planetary gears.

15. The sharpener of claim 3 wherein the radius provided by the second portion of the blade to the inner core is between about ⅛" and about 1/16" .

16. The sharpener of claim 15 wherein the radius provided by the second portion of the blade is about 1/16".

17. A portable sharpener for sharpening a cosmetic pencil having an outer casing of hard material and an inner casing of soft wax-like cosmetic material, comprising:

a housing having a hollow interior and an aperture at a first end for receiving the cosmetic pencil;

a first rotatable blade positioned within the housing for removing the outer casing of material from the cosmetic pencil so as to expose the inner core of cosmetic material;

a second rotatable blade positioned within the housing for providing a tip having a radius of no larger than about ⅛" to the inner core of cosmetic material;

a motor coupled to the blades to rotate the blades;

a power source to power the motor;

wiring between terminals connected to the power source and the motor to permit the flow of current from the power means to the driving means; and a chamber positioned within the hollow interior of the housing for receiving and storing material removed by the blade, and accessible from outside of the housing for removing stored material.

18. The portable sharpener of claim 7 further including a hinged lid for closing the apertured first end of the sharpener to prevent leakage of material removed by the blades through the aperture.

* * * * *